United States Patent [19]

Arnaudeau

[11] Patent Number: 4,725,203

[45] Date of Patent: Feb. 16, 1988

[54] LIQUID-GAS EJECTOR DEVICE AND METHOD USED TO PRODUCE A DIPHASIC FLOW

[75] Inventor: Marcel Arnaudeau, Paris, France

[73] Assignee: Institut Francais du Petrole, France

[21] Appl. No.: 839,825

[22] Filed: Mar. 13, 1986

Related U.S. Application Data

[63] Continuation of Ser. No. 541,572, Oct. 13, 1983.

[30] Foreign Application Priority Data

Oct. 13, 1982 [FR] France ..... 82 17245

[51] Int. Cl.[4] ..... F04F 5/24; F04F 5/48

[52] U.S. Cl. ..... 417/167; 417/179; 417/187; 417/197; 417/198

[58] Field of Search ..... 417/167, 179, 180, 182, 417/187, 188, 189, 196, 197, 198, 87, 185

[56] References Cited

U.S. PATENT DOCUMENTS

| | | | |
|---|---|---|---|
| 1,137,767 | 5/1915 | Leblanc | 417/174 |
| 1,596,523 | 8/1926 | Friedmann | 417/180 X |
| 2,100,185 | 11/1937 | Engstrand | 417/170 |
| 2,399,249 | 4/1946 | Perignat | 417/183 |
| 3,891,353 | 6/1975 | Templeman | 417/185 X |
| 4,332,527 | 6/1982 | Moldovan et al. | 417/87 X |
| 4,379,679 | 4/1983 | Guile | 417/179 X |

*Primary Examiner*—Edward K. Look

*Attorney, Agent, or Firm*—Antonelli, Terry & Wands

[57] ABSTRACT

A method for producing a flow of fluid comprised of at least phases from at least two primary flowing fluids, one of which has at least one liquid phase, and the other at least one gaseous phase, wherein the two primary fluids flow out respectively through one and another orifice, both of which may be streamlined, then a multiphase mixture is produced because the various flows are made to flow out through a third orifice and the channel sections of the orifices are adjusted in such a way so as to regulate at least one of the rate and pressure of the different flows, whereby a homogeneous multiphase flow is produced while minimizing the loss in energy of the different fluids.

17 Claims, 2 Drawing Figures

LIQUID-GAS EJECTOR DEVICE AND METHOD USED TO PRODUCE A DIPHASIC FLOW

Figure 1:
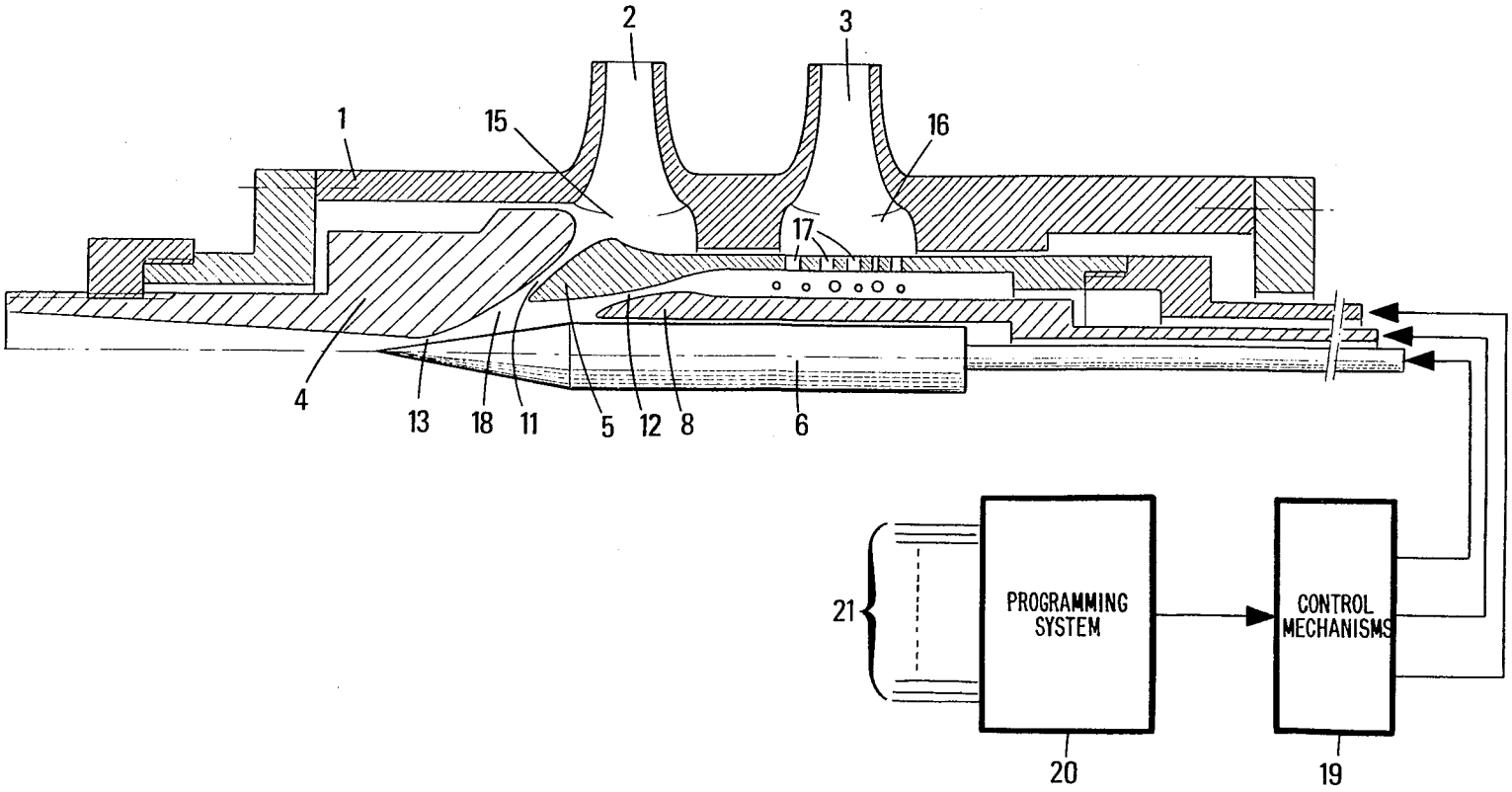

This application is a continuation of application Ser. No. 541,572, filed Oct. 13, 1983, now abandoned.

This invention relates to a liquid-gas ejector device and method used mainly to produce a homogeneous multiphase flow with a fluid structure determined by two flows, one of which has at least one gaseous phase, and the other at least one liquid phase. It is also used to control the flow rate and pressure of these different flows.

In the text that follows, the terms "above" and "below", relative to a device, are implicitly related to the direction of flow in the apparatus.

According to the invention, the method and device are mainly applicable to a transfer line of a multiphase flow or stream equipped with a phase separator. Thus, this invention makes it possible to produce a flow with the multiphase structure that most highly favors the transfer of the flow while still regulating the rate and pressure of the various flows.

The method as well as the device, according to the invention, are also applicable to transferring a fluid by mixing the fluid to be transferred with a carrier fluid that is to make the transfer.

According to the invention, the method makes it possible to produce a flow comprised of at least two phases from at least two primary flows which include a fluid with at least one liquid phase, called liquid fluid, and a fluid with at least one gaseous phase, called gaseous fluid respectively. According to this method, both primary fluids are made to flow out, respectively, through one and another orifice that may be streamlined if required. Then a multiphase mixture is produced because the various flows are made to flow out through a third orifice and the channel-forming section of said orifices are adjusted in such a way as to regulate the rate and/or pressure of the different flows, thus producing a homogeneous multiphase flow, yet still minimizing the loss in energy of the different fluids.

The prior state of the art may be illustrated by British Patent Nos. 1,205,675 and 930,080, German Patent Nos. 2,031,016 and 1,557,033, French Patent No. 1,128,095 and U.S. Pat. No. 1,437,649. None of the devices described in these patents, when the devices are applied to a multiphase flow can be used to regulate the rate and/or pressure of the different flows and still produce a homogeneous multi-phase flow and yet minimize the losses in energy of the various fluids.

The channel-forming section of at least one of said devices may, if necessary, be adjusted as a function of at least one variable characteristic of one of the flows.

Similarly, it is possible to adjust the channel-forming section of at least one of said orifices as a function of at least one variable characteristic of an outside order independent of the state of the fluid flows through said orifices.

It is also possible to adjust the channel-forming section of at least one of the orifices as a function of prior criteria, such as the minimization of the loss of energy of the multiphase flow.

This invention also relates to a liquid-gas ejector device that includes at least three convergent-divergent sections or passages, with at least one of these passages being adjustable. A fluid with at least one gaseous phase, to be called gaseous fluid, and another fluid with at least one liquid phase, to be called liquid fluid, and a third fluid (defined by a flow resulting from the mixture of the first two fluids), pass through one convergent-divergent or stream passage.

According to the invention, the liquid-gas ejector device has a means of controlling the channel-forming section through at least one of the convergent-divergent passages. The control mechanisms may be connected to a programming system.

According to the invention, the liquid-gas ejector device may, if necessary, have means that are used to transmit to the programming system at least one signal characteristic of the operation of the device, or outside orders to the device. A signal can be provided by a sensor that measures at least one of the variables created by the pressure, the temperature of the fluid, upward and downward of at least one of said convergent-divergent passages.

Figure 2:
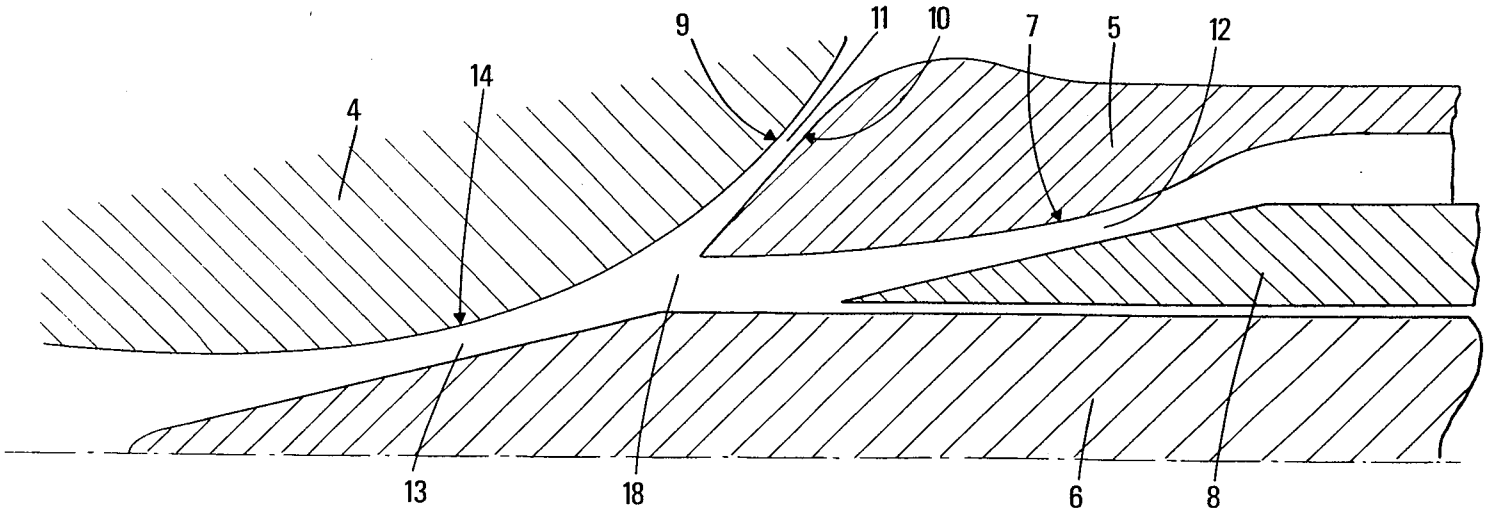

This invention will be better understood and its advantages will be apparent upon the following description of a non-limiting embodiment, illustrated by the accompanying drawings, in which:

FIG. 1 illustrates a longitudinal partial section of the device according to the invention; and FIG. 2 illustrates a detailed sectional view of the three convergent-divergent passages.

The following embodiment describes a particularly interesting case in which one of the primary fluids is essentially gaseous and the other essentially liquid. Yet, the scope of this invention is not exceeded if one and/or the other primary fluids is multiphase. Moreover, the device described below is perfectly applicable to use with such fluids.

In FIG. 1, which illustrates a partial section of an embodiment of the liquid gas ejector device according to the invention, (with a longitudinal half of the device not shown) reference numeral 1 designates the main body. Reference numerals 2 and 3 designate the intake orifices of gas and liquid, respectively. The scope of this invention is not exceeded by inversing the gas and liquid intake orifices 2, 3.

A double female part 4 is arranged in the main body 1. Part 4 is given this name because it works together with the, respective male portions of male-female 5 and male 6.

Part 5 is a male-female part. It is hollow, and a portion 7 (as shown in FIG. 2) of its inside wall has a female shape. The female portion 7 works together with the hollow male part 8. It is hollow to make it possible for the male part 6 to pass through it.

Parts 4, 5, 6 and 8 define three convergent-divergent passages.

The sonic collar or convergent-divergent passage 11, traversed by the gases, is an annular passage formed by the upper female portion 9 of the dual female part 4 and the male portion 10 of the male-female part 5.

The verturi or convergent-divergent passage 12, traversed by the liquid, is an annular passage formed by the female portion 7 of the male-female part 5 and by the male portion of the hollow male part 8.

Finally, the diphasic convergent-divergent section, or diphasic sonic collar 13, is an annular passage formed by the lower female portion 14 of the dual female part 4 and male part 6.

Below the gas intake orifice 2 is arranged a gas chamber 15 that feeds the sonic collar 11. Similarly, below the liquid intake orifice 3 is arranged a liquid chamber 16 that through the orifices 17 made in the wall of the malefemale part 5, feeds the venturi 12. The orifices 17 may be of diverse shapes and may be distributed, if necessary, in such a way that even in the male-female part 5 extreme positions, the liquid that arrives in the liquid chamber 16 can feed the venturi 12.

Below the sonic collar 11 and the venturi 12, but above the diphasic sonic collar 13, is a diphasic fluid chamber 18.

In the embodiment described, the male-female part 5, the hollow male part 8, and the male part 6 are movable independently of one another. However, it is of course possible to separately vary the channel section of each convergent-divergent passage by making connections between the movements of the different movable parts.

The connections between the movement of the various parts can be made using mechanical or other means, for example, by using a programming system that takes into account the movements ordered for one of the movable parts to control the movement of one or several of the other parts, in such a way that only the channel section of but one convergent-divergent passage varies.

The control mechanisms 19 are used to move the various movable parts of the three convergent-divergent passages. These mechanisms can be of any type, for example, those in electric or hydraulic engines, etc.

The control mechanisms 19 are driven by a programming system 20.

The programming system 20 defines the channel sections of the various convergent-divergent passages and drives the control mechanisms 19 so that the sections are effective.

The programming system 20 receives the information required for its operation from lines 21 that transmit signals representing measurement and/or orders.

The measurements that the programming system 20 receives are dependent on different installations and on conditions characteristic of the diphasic flows it regulates.

As examples, the measurements may be of one or several of the variables that follow, such as the pressure or temperature above or below the sonic collar 11, the pressure or temperature of the liquid above or below the venturi 12, the pressure or temperature of the liquid-gas mixture above or below the diphasic sonic collar 13, the flow rate of gas, the flow rate of liquid, the position of the various movable parts of the three convergent-divergent passages.

If the device according to the invention is incorporated into a device for transferring a diphasic flow, the programming system 20 can receive signals that represent the condition of the other diphasic devices or even orders from the same devices and/or outside orders, such as the structure of the diphasic flow that is sought. It can also transmit signals that represent its own condition as well as orders.

The operation of the device is illustrated by two examples that are in no way limiting.

In the first example, it is presumed that the pressure of the gas in 2 is identical to that of the liquid in 3. This case mainly exists if the device according to the invention is placed below a diphasic flow separator. If the rate of the gas flow increases and the rate of the liquid flow remains constant, the programming system will drive the control mechanisms so that both the male-female part 5 and the male part 6 are moved toward the right. Both movements are independent.

Inversely, if the flow rate of the liquid increases and that of the gas remains constant, the programming system will drive the control mechanisms 19 so that the hollow make part 8 and the male part 6 move toward the right. Both movements are independent.

In the second example, the pressure of the gas in the intake orifice 2 is presumed to be less than that of the liquid in the intake orifice 3. In this case, the device is used as a gas injector. Thus, the male part 8 is moved toward the left in order to balance the pressure in the diphasic fluid chamber 18. The male part 6 is adjusted as a function of the flow rate that must cross the diphasic sonic collar.

The following is an example of adjusting the device according to the invention, making it possible to generate a stable flow with a regular structure. Of course, the homogeneity of the flow is a function of the physical characteristics and the molecular composition of each of the phases, or a gaseous flow Q1 and a liquid flow Q2 that are to be processed by the device according to the invention in order to obtain a stable flow with a regular structure. To do so, a male-female part 5 is moved to adjust the sonic collar 11 to a value that enables the gaseous flow Q1 to pass with sonic blockage at the sonic collar 11. This necessitates static pressure in the diphasic fluid chamber 18. The position of the hollow male part 8 is adjusted so that the liquid flow Q2 that passes through the orifice 12 is subjected to a loss of pressure large enough so that the static pressure of the liquid in the chamber 18 is equal to the static pressure that already exists due to the expansion of the gases. The male part 6 is moved so that the diphasic sonic collar 13 is adjusted to a value such that it is possible for the diphasic liquid created in the chamber 18 to flow through diphasic sonic collar 13 at a speed equal to that of the propagation of the sound in the diphasic fluid itself. Of course, it is presumed that the level of the liquid and gas pressures above the sonic collar 11 and venturi 12, respectively, is sufficient to enable the operation described above to occur. This is obtained by creating a downward pressure that is less than the infinite upward pressure. The operation can be perfected after making several successive adjustments of the positions of the various parts, since moving one of the parts alters the flow conditions.

It is within the scope of this invention to provide mechanical assemblies other than the one shown in FIG. 1, and, in particular, assemblies which due to the movement of just one part alter only the channel section of but one convergent-divergent passage at a time.

Furthermore, the scope of this invention is not exceeded by applying the previously described method to fluids of the same nature, but which tend to separate from one another, such as two liquids of different densities that are not miscible and, consequently, the device according to the invention may also process this type of fluid mixture.

What is claimed is:

1. A method for producing a flow of fluid comprised of at least two phases from at least two primary flowing fluids, one of which has at least one liquid phase, and the other at least one gaseous phase, characterized in that the two primary fluids respectively flow through one and another orifice, both of which may be streamlined, then a multiphase mixture is produced because the various flows flow out through a third orifice and channel sections of each of said orifices are adjustable in such a manner so as to regulate at least one of the rate and pressure of the different flows, thus producing a homogenous multiphase flow, yet still minimizing the loss in energy of the different fluids.

2. A method, according to claim 1, characterized in that said channel section of at least one of said orifices is adjusted as a function of at least one variable characteristic of one of the fluids.

3. A method, according to claim 1, characterized in that said channel section of at least one of said orifices is adjusted as a function of at least one variable characteristic of an outside order independent of the condition of the flows of fluids through said orifices.

4. A method, according to claim 2, characterized in that said channel section of at least one of said orifices is adjusted as a function of at least one variable characteristic of an outside order independent of the condition of the flows of fluids through said orifices.

5. A method, according to claim 1, characterized in that the channel section of at least one of said orifices is adjusted as a function of previously established criteria.

6. A method, according to claim 2, characterized in that the channel section of at least one of said orifices is adjusted as a function of previously established criteria.

7. A method, according to claim 3, characterized in that the channel section of at least one of said orifices is adjusted as a function of previously established criteria.

8. A method, according to claim 4, characterized in that the channel section of at least one of said orifices is adjusted as a function of previously established criteria.

9. A method according to claim 1, characterized in that the channel section of at least one of said orifices is adjusted as a function of previously established criteria, such as minimizing the loss of the diphasic flow.

10. A method according to claim 2, characterized in that the channel seciton of at least one of said orifices is adjusted as a function of previously established criteria, such as minimizing the loss of energy of the diphasic flow.

11. A method according to claim 3, characterized in that the channel section of at least one of said orifices is adjusted as a function of previously established criteria, such as minimizing the loss of energy of the diphasic flow.

12. A method according to claim 4, characterized in that the channel section of at least one of said orifices is adjusted as a function of previously established criteria, such as minimizing the loss of energy of the diphasic flow.

13. A liquid-gas injector device, characterized in that the device has at least three convergent-divergent passages, one convergent-divergent is traversed by a fluid that has at least one gaseous phase, the second passage is traversed by a fluid with at least one liquid phase, the third passage is traversed by a flow resulting from the mixture of these two fluids, control means are provided for adjusting a cross-section of each of said passages, a main body is provided having a double female part, a male-female part, a hollow male part and a male part, said double female part comprising an upper female portion and a lower female portion, said male-female part comprising an external male portion and an internal female portion, said upper female portion of said double female part cooperating with said external male portion of said male-female part, said internal female portion of said male-female part cooperating with said hollow male part for respectively forming said first and second passages, said lower female portion of said double female part cooperating with said male part for forming said third passage.

14. A liquid-gas ejector device according to claim 13, characterized in that said device further comprises control means for varying the size of the channel section so as least one of the convergent-divergent passages.

15. A liquid-gas ejector device according to claim 14, characterized in that said control means is connected to a programming system.

16. A liquid-gas ejector device according to claim 15, characterized in that said device further comprises means for transmitting at least one signal characteristic of the operation of the liquid-gas ejector device to the programming system or outside orders to the liquid-gas ejector device.

17. A liquid-gas ejector device according to claim 16, characterized in that said signal is provided by a sensor that measures at least one of the variables created by the pressure, the temperature of the fluid upstream or downstream of at least one of said convergent-divergent passages.

* * * * *